US007289880B2

(12) United States Patent
Baack et al.

(10) Patent No.: US 7,289,880 B2
(45) Date of Patent: Oct. 30, 2007

(54) MICRO-PROCESSOR PROGRAMMABLE AND SELECTABLE VENDING OPTIONS AND CONTROL

(75) Inventors: Jerry Baack, Aiken, SC (US); Talbert James Black, Jr., Pelion, SC (US)

(73) Assignee: Dixie-Narco, Inc., Williston, SC (US)

( * ) Notice: Subject to any disclaimer, the term of this patent is extended or adjusted under 35 U.S.C. 154(b) by 535 days.

(21) Appl. No.: 10/678,182

(22) Filed: Oct. 6, 2003

(65) Prior Publication Data

US 2004/0108327 A1 Jun. 10, 2004

Related U.S. Application Data

(60) Provisional application No. 60/415,745, filed on Oct. 4, 2002.

(51) Int. Cl.
*G07F 17/00* (2006.01)

(52) U.S. Cl. ..... 700/241

(58) Field of Classification Search ..... 700/241
See application file for complete search history.

(56) References Cited

U.S. PATENT DOCUMENTS 3,203,588 A 8/1965 O'Neal
4,019,650 A 4/1977 Oden
4,036,400 A 7/1977 Oden
4,298,138 A 11/1981 Oden
4,354,613 A 10/1982 Desai et al.
4,600,094 A 7/1986 Hayashi et al.
5,050,769 A 9/1991 Levasseur
5,799,823 A 9/1998 Feltrin
6,202,888 B1 * 3/2001 Pollock et al. ..... 221/1
6,321,936 B1 11/2001 Feltrin
6,431,398 B1 8/2002 Cook et al.
6,561,380 B1 * 5/2003 Suzuki ..... 221/266
6,573,670 B2 6/2003 Machalek et al.
6,945,427 B2 * 9/2005 Hieb ..... 221/10
7,032,776 B2 * 4/2006 Hieb ..... 221/231
2001/0012975 A1 8/2001 Matsumoto

* cited by examiner

*Primary Examiner*—Patrick Mackey
*Assistant Examiner*—Michael E Butler

(57) ABSTRACT

A vending machine employing an electronic control unit which may be easily programmed initially with predefined angles of a cradle corresponding to existing products or vended items. The control unit has the option of setting custom vending angles with a new, previously unknown product package is to be vended from the machine, allowing a user to rapidly set up the machine for a range of package types. Custom angle settings may be used when needed to avoid loading a new control program whenever a new package type becomes available.

16 Claims, 6 Drawing Sheets

MICRO-PROCESSOR PROGRAMMABLE AND SELECTABLE VENDING OPTIONS AND CONTROL

CROSS-REFERENCE TO RELATED APPLICATION

The present application claims the benefit of U.S. Provisional Patent Application Ser. No. 60/415,745 entitled "MICRO-PROCESSOR PROGRAMMABLE AND SELECTABLE VENDING OPTIONS AND CONTROL" filed Oct. 4, 2002.

BACKGROUND OF THE INVENTION

1. Field of the Invention

In general, the invention is directed to the field of vending or dispensing machines adapted to dispense cylindrical items such as bottles or cans.

2. Discussion of the Prior Art

Various vending machines have been proposed in the past to vend articles such as bottles and cans stored in multiple columns located within a cabinet. Typically, in the prior art, various different mechanisms have been proposed to vend a single item at a time from such a storage arrangement. For example, a semi-cylindrical cradle mounted for rotation about an axis under each column of articles has been proposed such that articles enter the cradle and as the cradle rotates the articles are dispensed. The cradle may be segmented so that front or rear articles are vended depending on the rotational angle of the cradle. See for example, U.S. Pat. No. 4,298,138 incorporated herein by reference.

Alternatively, there has been proposed to use an oscillating bail to selectively release a single article at a time. During an initial swinging motion of the bail, an article will be released from the front or rear of one of the columns in the cabinet and further movement of the bail thereafter releases an article from the other of either the front or rear of the column so that multiple articles can be released from the single column. See for example U.S. Pat. Nos. 4,019,650 and 4,036,400 both of which are incorporated herein by reference.

Often in prior art vending machines when the cradle or bail has reached a certain position or predetermined vend angle, a product will be dispensed. Typically a switching means provides a signal to the vending machine's controller to indicate that the dispensing position has been reached. Of course the use of such a switching device to provide a signal to the control unit takes up space in the vending machine and thereby reduces the quantity of articles that the machine is able to hold. Such a educed quantity of articles in the vending machine requires vending machine operators to fill the machines more often and is generally considered less efficient and less desirable. However, in the past such a switching means has been necessary to easily allow an operator to simply change the mechanical switch setting when a new product package becomes available and is placed in the vending machine.

As can be seen from the above discussion, there exists a need in the art of vending machines for a mechanism to signal the vending machine controller, the vending angle of a cradle or bail for a given product which does not require a sensing switch and is easy to set up when new products are loaded into the vending machine.

SUMMARY OF THE INVENTION

The present invention employs an electronic control unit in a vending machine which may be easily programmed initially with predefined vending angles of a cradle corresponding to existing products or vended items and, additionally, has the option of setting custom vending angles when a new, perhaps previously unknown, product package is to be vended from the machine. The predefined storage angles allow a user to rapidly set-up the machine for existing package types, thereby avoiding wasting time by having to enter custom angle settings for all package types. Also the option of using a custom angle settings when needed solves the problem of requiring a new control program to be loaded whenever a new package type becomes available.

Specifically, the vending machine control mechanism of the present invention employs a vending machine menu system controller wherein a user can select a certain mode, such as a "package" option, wherein certain settings may be inputted into the machine. Specifically, in the package mode, the user is prompted to select a particular column in the machine for which the package type is going to be changed. The user can either select a single column to be adjusted or select all the columns so that they may all be adjusted at once. Of course selecting all columns decreases the amount of time required to set the package type if the entire machine is dispensing the same type of packages. Upon selecting either the "all" or specific column, the menu then switches to prompt the user to select either a predefined package type, such as, for example, a can or a bottle, or a custom selection. The number and variety of predetermined package types is only limited by the space for the software existing in the memory of the vending machine. If a predefined package type is selected, then the angles needed for the controller are loaded from existing software tables or from algorithms that calculate the dispensing angles. These new settings may be saved and the machine is ready for operation. However, if the user selects a custom setting, the user is prompted to enter the angle of rotation that will cause a product to be dispensed and then the angle for the pre-dispensed position. After entry of these angles or the selection of a predefined setting, the user is then given a save prompt. If the user selects the save prompt, then the changes made by the user are saved. However, the user may also select a cancel operation, in which case the settings are returned to their prior values and the operator is returned to the column selection prompt where the operator can chose to exit to the main level or modify the package type of a different column.

Additional objects, features and advantages of the present invention will become more readily apparent from the following detailed description when taken in conjunction with the drawings wherein like reference numerals refer to corresponding parts.

DETAILED DESCRIPTION OF THE PREFERRED EMBODIMENT

Figure 1:
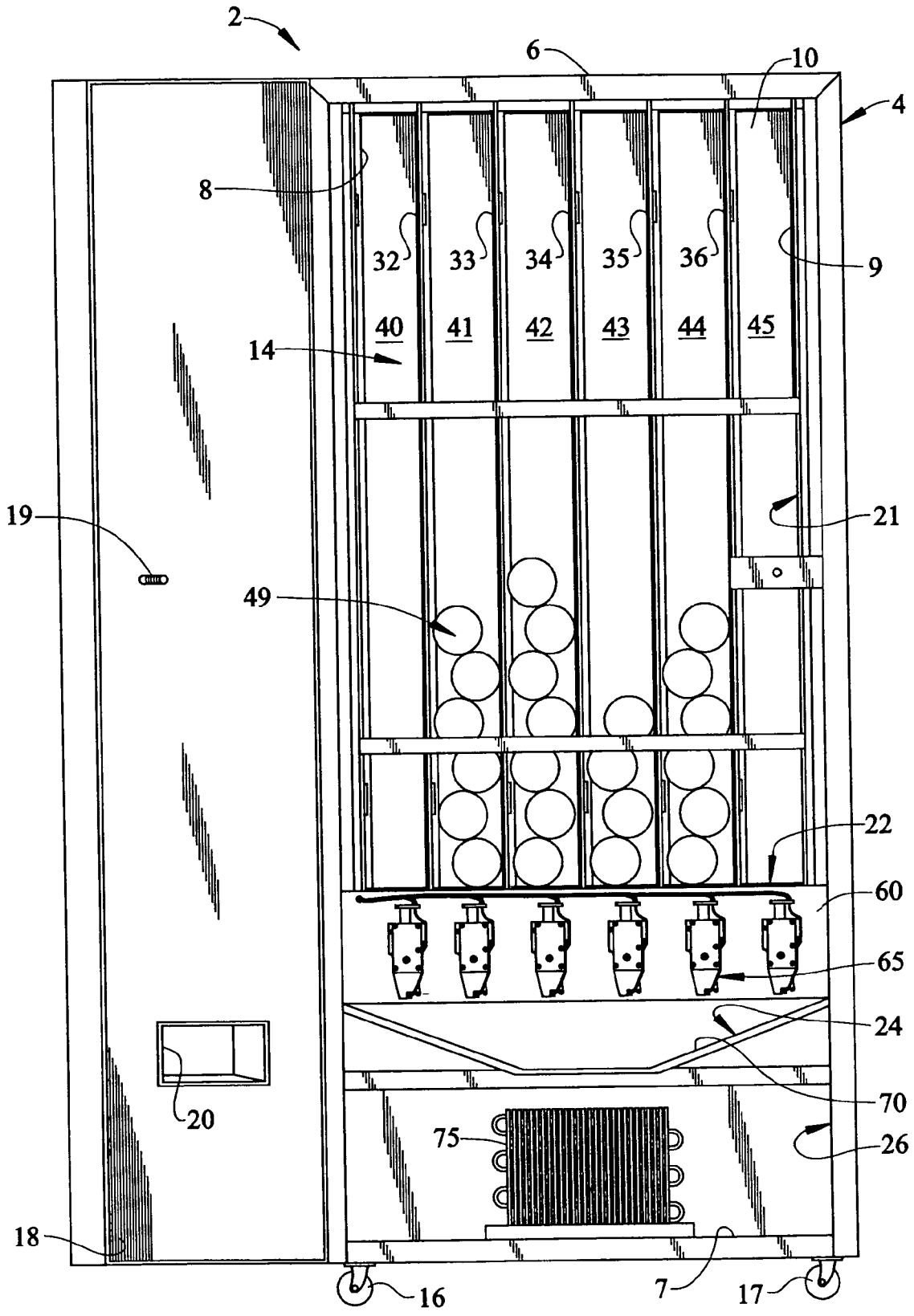
FIG. 1 is a front plan view of the inside of a vending machine incorporating a vending machine controller according to a preferred embodiment of the present invention.

With initial reference to FIG. 1, a vending machine 2 includes a cabinet frame 4 having top, bottom, side and rear walls 6-10 that collectively define a central cavity 14. In a manner known in the art, a first pair of wheels or casters 16 and 17 are secured to a front edge portion of bottom wall 7 to facilitate the positioning of vending machine 2. Of course it should be realized that a second pair of wheels (not shown) are also arranged on a rear portion of bottom wall 7. A door 18 is pivotally mounted to cabinet frame 4 to selectively enable access to central cavity 14 in order to load various product containers or other commodities into vending machine 2. Door 18 is provided with a locking mechanism, shown in the form of a threaded rod 19, to retain door 18 in a closed position so as to prevent pilfering of the commodities from central cavity 14. Door 18 is also provided with an opening 20 to enable a consumer to remove a vended product container or other commodity from vending machine 2.

Central cavity 14 includes a storage section 21, a dispensing section 22, a delivery section 24 and a lower section 26. Storage section 21 is provided to hold products in escrow until a vending operation is performed. Towards that end, storage section 21 is provided with a plurality of vertically extending column walls 32-36 which, together with side walls 8 and 9, form a plurality of column or stack areas 40-45. In the embodiment shown in FIG. 1, stack areas 40-45 constitute single stack columns. However, it should be understood that the present invention also encompasses vending machines having multi-stack columns. In any event, stack areas 40-45 are partitioned by walls 32-36 to contain, separate and support a plurality of generally cylindrical product containers 49 which, in the embodiment shown, constitute soda cans.

Figure 4:
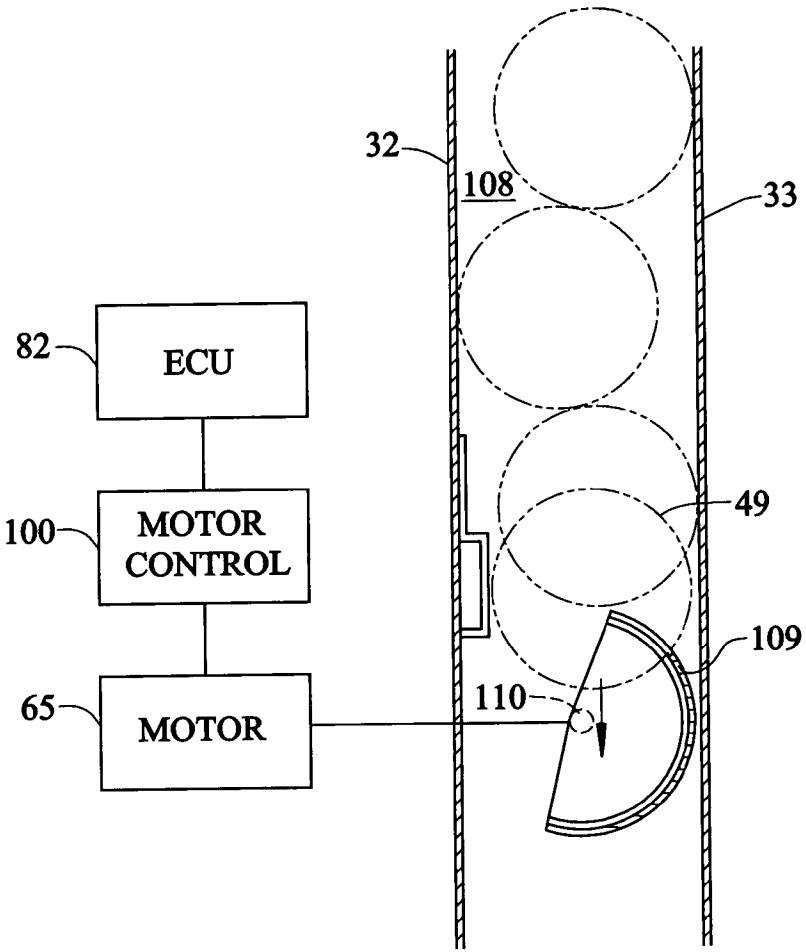
FIG. 4 is another schematic view showing the dispensing of articles from a column in the vending machine.
Figure 3:
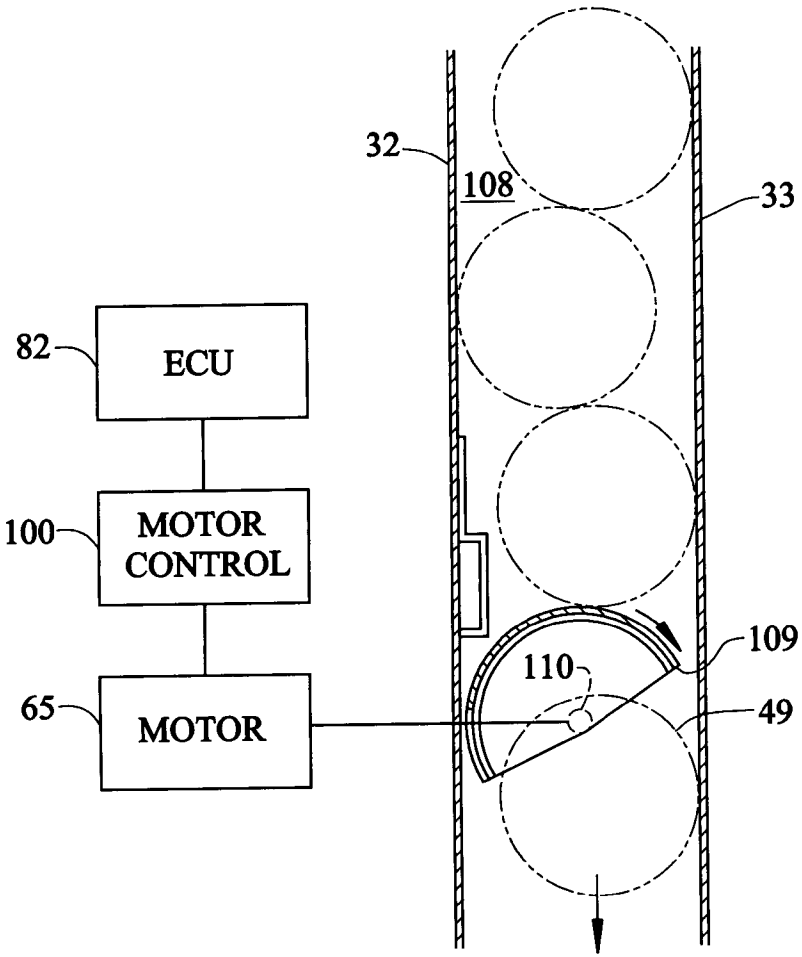
FIG. 3 is a schematic view showing the dispensing of articles from a column in the vending machine.

As further shown in FIG. 1, dispensing section 22 is provided with a frontal support wall 60 having arranged thereon a plurality of vend motors 65. Behind support wall 60 are arranged a plurality of bails or cradles, as shown in FIGS. 3 and 4 and discussed below. Actually, each column or stack area 40-45 is provided with an associated bail or cradle hereinafter referred to as a cradle operated through a respective one of the plurality of vend motors 65. Upon selection of a particular product container 49 or other commodity, one of the plurality of vend motors 65 is activated to rotate a respective cradle causing a product container or package 49, corresponding to the selected product to emerge from vending machine 2. That is, container 49 is transported to a product delivery chute 70 provided in delivery section 24 which is exposed to opening 20 in door 18. In order to maintain containers 49 in a refrigerated state, lower section 26 is provided with a cooling system 75.

Figure 2:
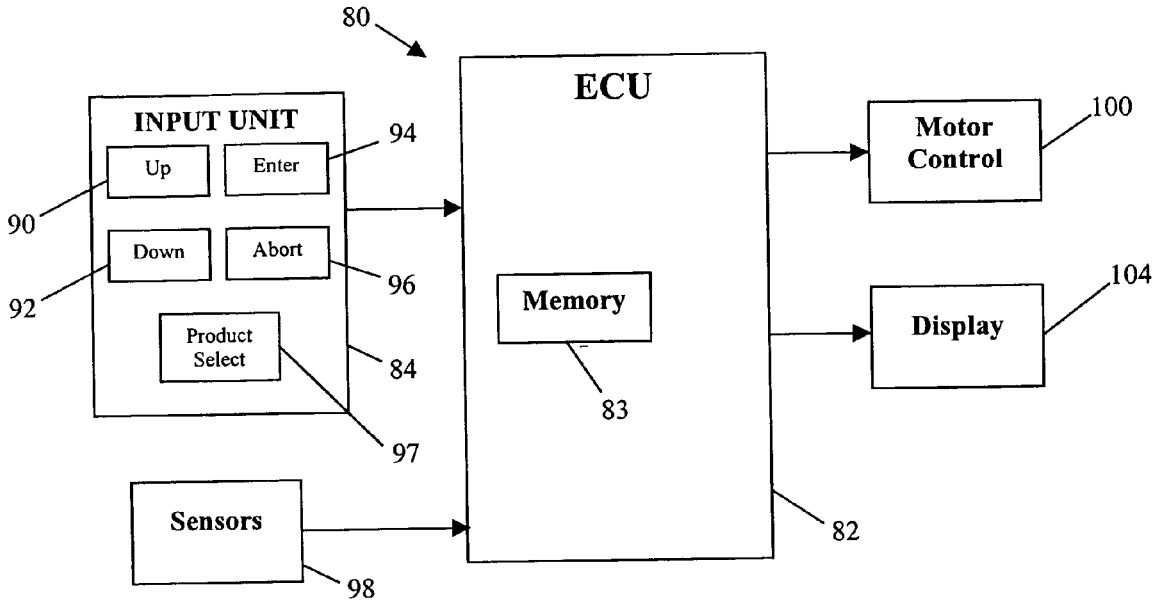
FIG. 2 is a block diagram of the vending machine controller according to a preferred embodiment of the present invention.

The above description is provided for the sake of completeness and to enable a better understanding of the drawings. The present invention is particularly directed to the incorporation of a vending machine controller into vending machine 2. Referring now to FIG. 2, there is shown a block diagram depicting an overall vending machine controller 80 for controlling vending machine 2. In accordance with the most preferred embodiment of the invention, an electronic control unit (ECU) 82 is provided with memory 83. An input unit 84 has numerous buttons which may be depressed by an operator to provide ECU 82 with information. Specifically provided are up and down buttons 90 and 92 along with an enter button 94 and an abort button 96. These buttons 90, 92, 94 and 96 are preferably located on a panel only available to the vending machine owner. Additionally provided are product select buttons, generally indicated at 97, which will vend a particular product when depressed. Various sensors 98 provide ECU 82 with information regarding vending machine 2. Signals from input unit 84 and sensors 98 are all sent to ECU 82. ECU 82 can also send information to a motor control 100 which regulates motor 65. Additionally, ECU 82 can send signals to the user via a display unit 104.

Referring now to FIGS. 3 and 4, there is representatively shown stack area 41 in the form of a rectangular compartment 108 which is located within cabinet frame 4 of vending machine 2. Compartment 108 includes side walls 32 and 33 that are designed to retain containers 49 in a column like configuration. A cradle 109 is provided on a stub shaft 110 and mounted in a rotatable manner between side wall 32 and side wall 33. In operation, as cradle 109 rotates, a respective container 49 located between side walls 32 and 33 will drop by the force of gravity into cradle 109 so as to be ready for vending. When a customer deposits money into vending machine 2, cradle 109 will rotate further so that, at a certain angle of rotation, one container 49 will be dispensed. After container 49 is dispensed, continued rotation of cradle 109 to a certain angle will allow the next consecutive container 49 to be received within cradle 109 and the operation is ready to begin once again upon insertion of additional coins by a customer. Motion of cradle 109 is caused by motor 65 which turns shaft 110 and is controlled by motor control 100 which is actuated by ECU 82.

Figure 5:
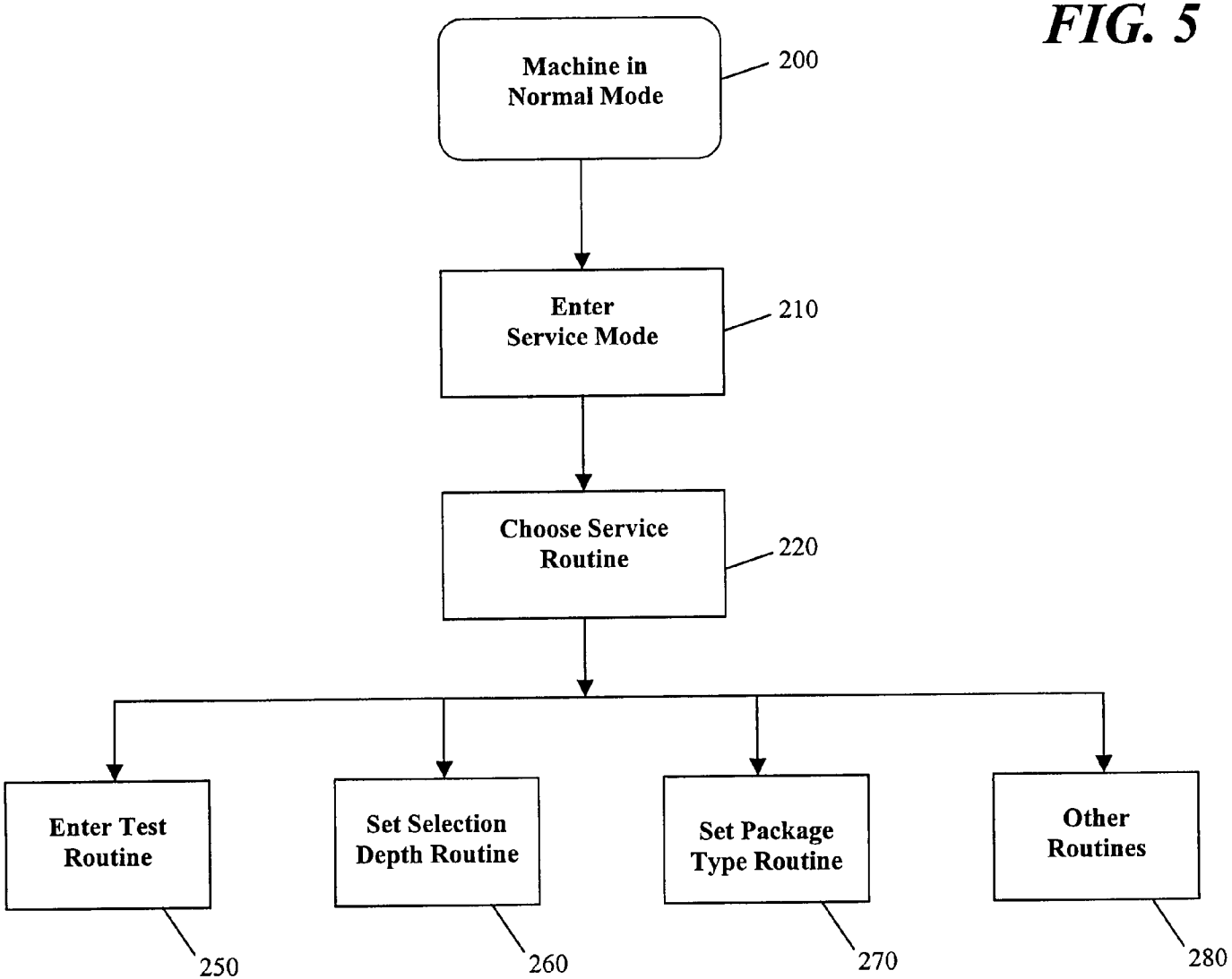
FIG. 5 is a flow chart showing the overall logic followed during a service mode in the vending machine.

Referring now to FIG. 5, there is depicted a flow chart illustrating the overall operation of controller 80 of vending machine 2 when controller 80 enters a service mode. Initially, vending machine 2 machine operates in a normal mode at step 200. During this mode, vending machine 2 operates in a generally conventional manner to dispense containers 49 in response to money deposited by customers who desire a product. When vending machine 2 is to be serviced, vending machine 2 is put into a service mode as depicted in step 210. Once vending machine 2 enters the service mode, the owner or operator can select one of several menu options to either read data registers located within memory unit 83 or program machine configuration information. Service mode 210 might be called a code level because display 104 will operate to display codes of all the possible routines available to the operator. The operator may scroll through the various codes in step 220 by using up button 90 or down button 92, with the code for each routine is displayed in sequence. While other routines 280 may be made available, an enter test routine 250, a set selection depth routine 260 and a set package type routine 270 will be discussed here.

Once the desired routine is presented in display unit 104 by using up and down buttons 90 and 92, enter button 94 is pressed in order to select that particular routine. Alternatively, abort button 96 may be selected, in which case, controller 80 returns to the normal mode. While up and down buttons 90, 92, along with enter and abort buttons 94, 96, have been mentioned here, any other type of input maybe used to communicate with vending machine controller 80. For example, a numeric keypad or an alpha numeric keyboard could be used to enter such information.

Figure 6:
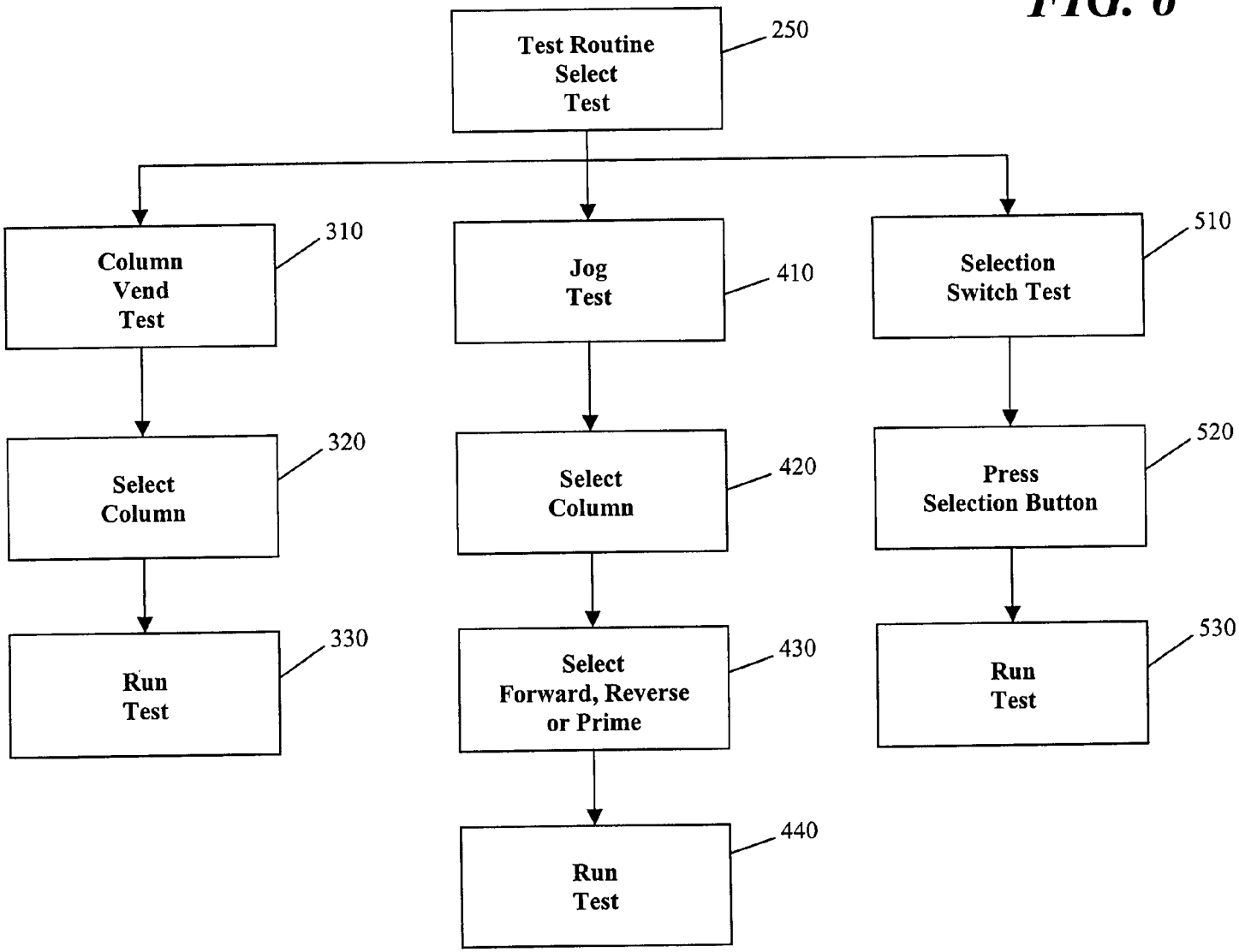
FIG. 6 is a flow chart showing a test routine of FIG. 5 in more detail.

Once a particular routine is entered, vending machine controller 80 will show on display unit 104 what particular routine is currently being used. With respect to the test routine having a select test menu 250 as shown in FIG. 6, display 104 will show the first test to be available. For example, the default test could be a column vend test 310 used to determine whether or not a particular compartment or stack area 40-45 is vending properly. However, once again the operator may use up or down button 90, 92 to scroll through the various available tests, such as a column vend test 310, a jog test 410, and a selection switch test 510. While these three tests have been disclosed here, numerous other tests could also be incorporated into the vend test routine. Once a particular test is selected, enter button 94 is pushed and the particular test will be run. Activation of abort button 96 will return vending machine controller 80 to a service routine menu 220 where the first particular routine is displayed.

If column vend test 310 is chosen, display unit 104 shows a message indicating that a test vend of compartment 108 of vending machine 2 is to be initiated. Once again, use of up or down button 90, 92 will cycle through the available choices. In this case, the routine allows cycling between the various different compartments or stack areas 40-45 of vending machine 2. Once a particular column or stack area 40-45 is selected, depression of enter button 94 will initiate the running of a test vend 330 of that displayed compartment. Activation of abort button 96 returns vending machine controller 80 to the select test menu 250 so that other tests may be chosen.

If jog test 410 is chosen by enter button 94 being activated when the jog prompt is displayed, vending machine controller 80 enters jog test routine 410 and shows a message indicating that the jog test will be conducted on compartment 108 of vending machine 2 on the display 104. Use of the up or down button 90, 92 at this point will cycle through the available compartments which may be tested. Once a particular compartment or column is chosen at step 420, display 104 will indicate a forward direction message indicating that the test will be done in a forward direction. Using up or down button 90, 92, vending machine controller 80 will sequentially present or scroll through the forward direction, the reverse direction or the prime test at step 430. Activation of enter button 94 will initiate whatever test 440 was being displayed. During the actual jog test, the direction of travel will remain indicated on display unit 104 and vending machine controller 80 will be activated, and remain activated, until enter button 94 is released. Vending machine controller 80 will continue to cause motor 65 to rotate in the same direction of travel without regard to vend position. During the entire jog test process, the various mechanisms, i.e., motors and switches of vending machine 2, will be monitored by sensors 98 so that the test may be interrupted before any damage to part of the mechanism could occur.

During a prime test, a prime test signal will remain indicated on display 104 during the test. Again, vending machine controller 80 will remain activated until the last indicated compartment or stack area 40-45 has completed priming. Throughout the entire prime process, sensors 28 will monitor all the mechanisms, motor and switches, and the prime test will be interrupted should continuation of the test potentially damage any part of vending machine 2.

In a similar manner, selecting switch test 510 be entered by pressing of enter button 94 when select switch test 510 is indicated in display 104. When any selection button 97 is depressed, as at step 520, a run test will be performed at 530 and a corresponding selection number will be displayed on display 104 to indicate that the selection switch is working. The last selection switch will remain on display 104 until a timer expires or abort button 96 is pressed and held for two seconds, at which point vending machine controller 80 will return to test menu 250.

Figure 7:
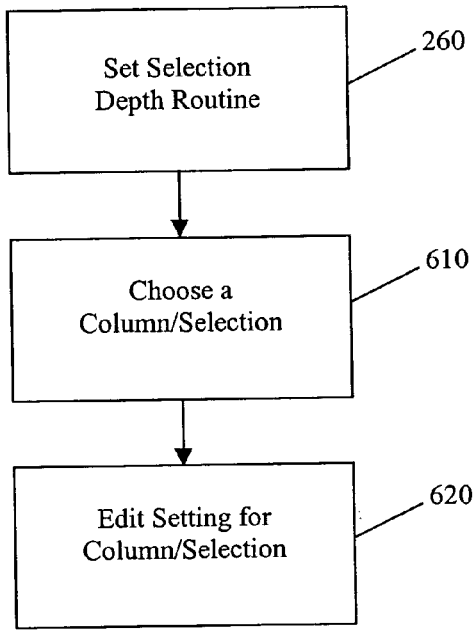
FIG. 7 is a flow chart showing a set selection depth routine of FIG. 5 in more detail.

Turning now to FIG. 7, set selection depth routine 260 will be discussed in more detail. Once set selection depth routine 260 has been selected, display 104 will show the current setting for the particular product, along with the number of containers 49 that can be loaded and the depth of the particular compartments or stack areas 40-45 assigned to that selection. For example, if an "01,01" is presented on display 104, product type number 1 can be stacked one container deep. If display 104 were to present "03,02", product number 3 could be stacked two containers 49 deep in each associated stack area 40-45. Using up or down buttons 90, 92 will cycle through all the available selections at step 610. At the end of the last selection, the option of choosing all of the selections will appear. At any time, activation of abort button 96 returns vending machine controller 80 to step 220 with display 104 showing set selection depth routine 260. When a particular selection change is displayed, the pressing of enter button 94 enables vending machine controller 80 to enter an edit mode at 620. In edit mode 620, the up or down buttons 90, 92 will be used to increase or decrease the number of containers 49 that are able to be placed in each stack area 40-45. Finally, the new setting is activated by pushing enter button 94 to save the displayed setting within vending machine controller 80. Activation of abort button 96 while in edit mode 620 simply disables all changes without saving the displayed setting and returns vending machine controller 80 to step 260.

Figure 8:
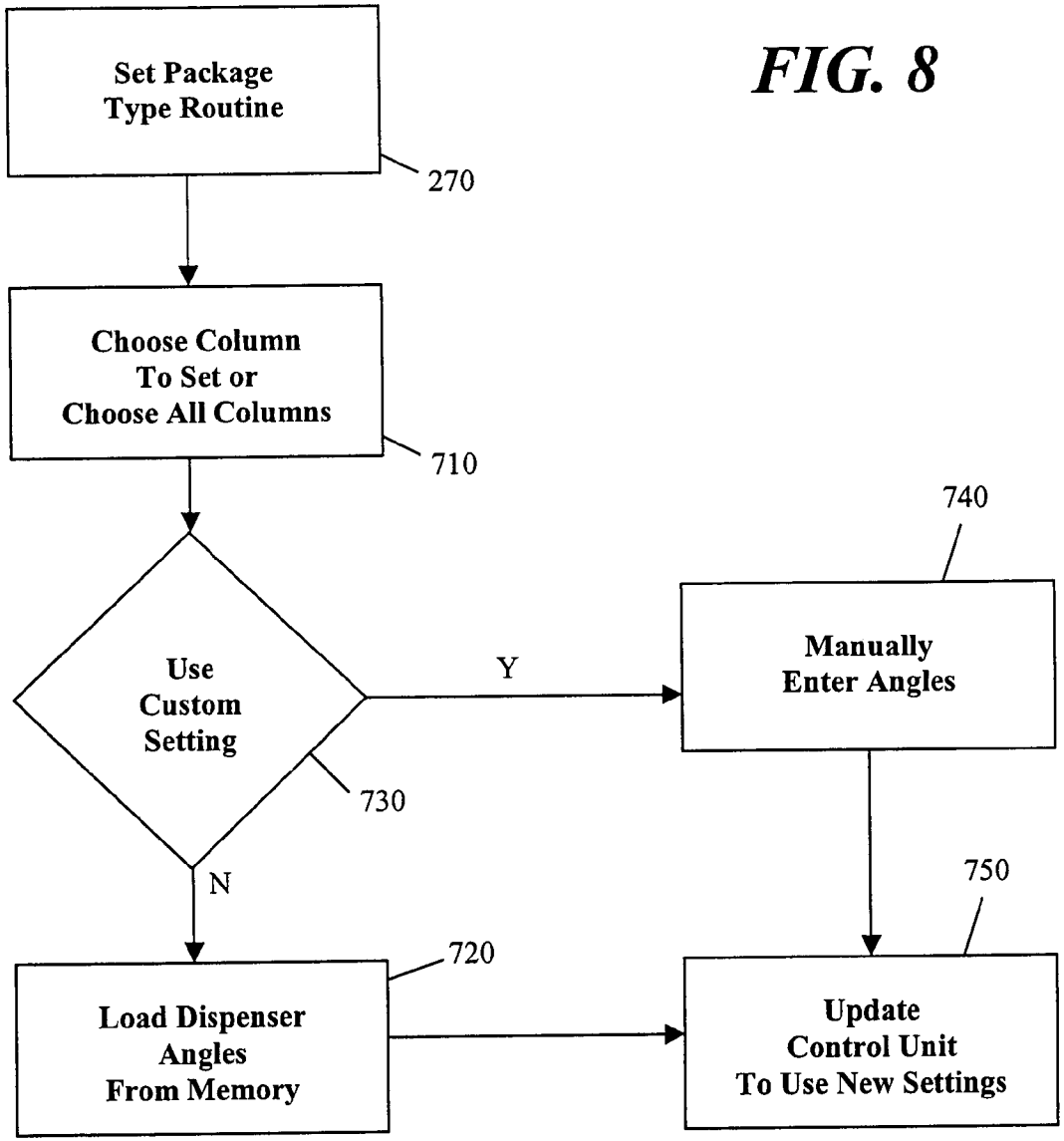
FIG. 8 is a flow chart showing a set package type routine of FIG. 5 in more detail.

Turning now to FIG. 8, there is shown set package type routine 270 in greater detail. If the operator of vending machine 2 requires that vending machine controller 80 know exactly the package size of a particular product loaded into a stack area 40-45, set package type routine 270 must be used. When the set package routine prompt is displayed on display 104 and enter button 94 is activated, vending machine controller 80 enters set package type routine 270. Upon entry into this routine, display 104 will show the current setting for a selection indicating both the type of package and the particular stack area 40-45 in which the package is located. Using up or down buttons 90, 92 will sequence through the present settings at step 710 for all the available compartments or stack areas 40-45 within vending machine 2. Additionally, an "all" selection is available so that all compartment settings may be adjusted at one time. Finally, pressing enter button 94 in step 720 saves the displayed setting and exits the edit mode. Activation of abort button 96 while in the edit mode will delete the changes without saving and returns vending machine controller 80 to step 270.

The settings for standard products chosen during this edit routine are preprogrammed into vending machine controller 80 based on standard packages to be vended. These settings of the angle required for either an oscillating bail or a rotating cradle are stored in memory 83 of ECU 82. As can be seen from the above discussion, the loading of preset angles in step 720 for vending and pre-vending enable an operator to quickly set-up vending machine controller 80 to different known packages. However, should a new package be placed in vending machine 2, selection of a custom setting, as shown in step 730, must be made so that the angles for the vend position and pre-vend position of cradle 109 may be set.

Upon entry of the set custom angles routine, the prompt for a first package will be displayed. Use of up or down buttons 90, 92 increases or decreases the settings of the angles for the product and a particular number and stack area 40-45 can then be entered. Once the desired angle setting has been displayed, enter button 94 may be pressed in step 740 so that the vend angle setting for that product will be known by vending machine controller 80. Activation of abort button 96 will cause the settings to revert to their default values. After the vend angle has been entered, use of up or down buttons 90, 92 adjusts the display of valid hold angles for a product. Again, activation of abort button 96 cancels the selection. However, activation of enter button 94 will cause the current product angle number to be displayed and the current hold angle number to be stored in a temporary location. Once both the angle for the vending and the angle for the hold have been temporarily stored and are correct, activation of enter button 94 will cause all vend angle and hold angle settings to be stored at step 750 in memory 83 so that vending machine 2 may now vend a new product or package of a different non-standard size.

Based on the above, it should be apparent that the present invention enables the vending machine to control rotation of the output of each of the plurality of vend motors through a desired vend angle, with the desired vend angle being readily established based on the product container to be dispensed. With the electronic control unit including a memory having stored therein various predetermined vend angles corresponding to known product containers, while being easily programmable to retain supplementary vend angles for additional product containers. The programming can be performed on each individual stack area such that the vending machine can be used in connection with dispensing a wide range of differently configured products, or vending information for all of the stack areas can be established simultaneously. In addition, the electronic control unit advantageously enables a series of program routines to be executed, thereby further increasing the overall versatility of the vending machine for present and future use.

Although described with reference to a preferred embodiment of the invention, it should be readily understood that various changes and/or modifications can be made to the invention without departing from the spirit thereof. For instance, the particular manner in which the programming and option selections are carried out can be varied from the button arrangement described above. For instance, a touch screen could be employed. In addition, the particular programming/selection sequences could be altered, while still performing corresponding functions to that described above. In general, the invention is only intended to be limited by the scope of the following claims.

We claim:

1. A vending machine comprising:

a cabinet frame including top, bottom, side and rear walls that collectively define a central cavity;

a plurality of column walls defining a plurality of stack areas for storing columns of product containers to be vended;

a door mounted to the cabinet frame for selectively closing the central cavity;

a plurality of dispensing units, each of the plurality of dispensing units being adapted to receive product containers from an associated one of the plurality of stack areas;

a plurality of vend motors connected to the plurality of dispensing unit, each of the plurality of vend motors including a rotatable output for selectively operating a respective one of the dispensing units to dispense the product containers; and an electronic control unit adapted to control rotation of the output of each of the plurality of vend motors through a desired vend angle, with the desired vend angle being established based on the product container to be dispensed, said electronic control unit including a memory having stored therein various predetermined vend angles corresponding to known product containers while being programmable to retain supplementary vend angles for additional product containers, wherein the electronic control unit can selectively operate in a set package mode where the desired vend angle for a select one of the plurality of vend motors can be changed.

2. The vending machine according to claim 1, wherein the desired vend angle for each of the plurality of vend motors can be individually set.

3. The vending machine according to claim 1, wherein the desired vend angle for each of the plurality of vend motors can be simultaneously adjusted.

4. The vending machine according to claim 1, wherein the electronic control unit is operable in various routines, including test, set selection depth and set package type routines.

5. The vending machine according to claim 4, wherein the test routine includes column vend, jog and selection switch tests.

6. A vending machine comprising:

a cabinet frame including top, bottom, side and rear walls that collectively define a central cavity;

a plurality of column walls defining a plurality of stack areas for storing columns of product containers to be vended;

a door mounted to the cabinet frame for selectively closing the central cavity;

a plurality of dispensing units, each of the plurality of dispensing units being adapted to receive product containers from an associated one of the plurality of stack areas;

a plurality of vend motors connected to the plurality of dispensing units, each of the plurality of vend motors including a rotatable output for selectively operating a respective one of the dispensing units to dispense the product containers;

an electronic control unit adapted to control rotation of the output of each of the plurality of vend motors through a desired vend angle, with the desired vend angle being established based on the product container to be dispensed, the electronic control unit including a memory having stored therein various predetermined vend angles corresponding to known product containers while being programmable to retain supplementary vend angles for additional product containers; and a display for use in programming the electronic control unit.

7. The vending machine according to claim 6, wherein the electronic control unit prompts a user, through the display, for both the desired vend angle and a pre-dispensed setting.

8. The vending machine according to claim 7, wherein each of the desired vend angle and the pre-dispensed setting are stored in the memory.

9. A vending machine comprising:

a cabinet frame including top, bottom, side and rear walls that collectively define a central cavity;

a plurality of column walls defining a plurality of stack areas for storing columns of product containers to be vended;

a door mounted to the cabinet frame for selectively closing the central cavity;

a plurality of dispensing units, each of the plurality of dispensing units being adapted to receive product containers from an associated one of the plurality of stack areas;

means for shifting the plurality of dispensing units through desired vend angles for dispensing of product containers from the plurality of stack areas; and means for controlling the shifting means, said controlling means including a memory having stored therein various predetermined vend angles corresponding to known product containers, while being programmable to retain supplementary vend angles for additional product containers wherein the controlling means can selectively operate in a set package mode where the desired vend angle for a select one of the plurality of dispensing units can be changed.

10. The vending machine according to claim 9, wherein the desired vend angle for each of the plurality of dispensing units can be individually set.

11. The vending machine according to claim 9, wherein the desired vend angle for each of the plurality of vend motors can be simultaneously adjusted.

12. The vending machine according to claim 9, wherein the controlling means is operable in various routines, including test, set selection depth and set package type routines.

13. The vending machine according to claim 12, wherein the test routine includes column vend, jog and selection switch tests.

14. A vending machine comprising:

a cabinet frame including top. bottom, side and rear walls that collectively define a central cavity;

a plurality of column walls defining a plurality of stack areas for storing columns of product containers to be vended;

a door mounted to the cabinet frame for selectively closing the central cavity;

a plurality of dispensing units, each of the plurality of dispensing units being adapted to receive product containers from an associated one of the plurality of stack areas;

means for shifting the plurality of dispensing units through desired vend angles for dispensing of product containers from the plurality of stack areas;

means for controlling the shifting means, the controlling means including a memory having stored therein various predetermined vend angles corresponding to known product containers while being programmable to retain supplementary vend angles for additional product containers; and a display for use in programming the controlling means.

15. The vending machine according to claim 14, wherein the controlling means prompts a user, through the display, for both the desired vend angle and a pre-dispensed setting.

16. The vending machine according to claim 15, wherein each of the desired vend angle and the pre-dispensed setting are stored in the memory.

* * * * *

UNITED STATES PATENT AND TRADEMARK OFFICE

CERTIFICATE OF CORRECTION

PATENT NO. : 7,289,880 B2
APPLICATION NO. : 10/678182
DATED : October 30, 2007
INVENTOR(S) : Jerry Baack and Talbert James Black, Jr.

It is certified that error appears in the above-identified patent and that said Letters Patent is hereby corrected as shown below:

Column 1, line 54, delete “educed” and replace with --reduced--;

Column 8, claim 1, line 2, delete “unit” and replace with --units--.

Signed and Sealed this

Thirteenth Day of May, 2008

JON W. DUDAS
*Director of the United States Patent and Trademark Office*